US006604705B2

(12) United States Patent
Pellegri et al.

(10) Patent No.: US 6,604,705 B2
(45) Date of Patent: Aug. 12, 2003

(54) CONTROL GROUP FOR DIRECTIONAL FINS ON MISSILES AND/OR SHELLS

(75) Inventors: Mauro Pellegri, Villafranca Lunigiana (IT); Angelo Schino, San Terenzo (IT)

(73) Assignee: OTO Melara S.p.A., La Spezia (IT)

( * ) Notice: Subject to any disclaimer, the term of this patent is extended or adjusted under 35 U.S.C. 154(b) by 0 days.

(21) Appl. No.: 10/101,140

(22) Filed: Mar. 19, 2002

(65) Prior Publication Data

US 2002/0139896 A1 Oct. 3, 2002

(30) Foreign Application Priority Data

Mar. 27, 2001 (IT) ..... MI2001A0648

(51) Int. Cl.[7] ..... F42B 10/06
(52) U.S. Cl. ..... 244/3.24; 244/3.21
(58) Field of Search ..... 244/3.21, 3.24, 244/3.28, 3.29

(56) References Cited

U.S. PATENT DOCUMENTS 3,072,365 A * 1/1963 Linscott et al.
3,976,266 A 8/1976 Fieuzal
4,029,270 A * 6/1977 Niemeier
4,964,593 A 10/1990 Kranz
5,423,497 A * 6/1995 Ransom
5,467,940 A * 11/1995 Steuer
5,950,963 A * 9/1999 Speicher et al.
5,975,461 A 11/1999 Ullrich

FOREIGN PATENT DOCUMENTS

DE 3838737 * 5/1990 ..... 244/3.24
GB 2231942 * 11/1990 ..... 244/3.29

OTHER PUBLICATIONS

EP Search Report.

* cited by examiner

*Primary Examiner*—Tien Dinh
(74) *Attorney, Agent, or Firm*—Hedman & Costigan, P.C.

(57) ABSTRACT

Control group for directional fins on missiles and/or shells which have a containment body (15, 15', 15") that has on the outside of the containment body, two command surfaces in the form of half-fin surfaces (13, 14) which are hinged (at 24, 25), directable and motorized. The containment body (15, 15', 15") has two housings (16) each of which has an electric motor (17, 17') which commands, through a reduction gear group (19, 29; 19', 29'), the oscillation about the axis (Z) of a control group that is based on a pair of rings (21, 22), arranged in annular seats (31, 32) and in which end attachments (26) of the half-fins (13, 14) engage, the half-fins (13, 14) being hinged so that they are diametrically opposed in a further ring (20) arranged in an annular seat (23) of said containment body (15, 15', 15") where they are free to rotate about the (Z) axis.

9 Claims, 3 Drawing Sheets

Figure 4:
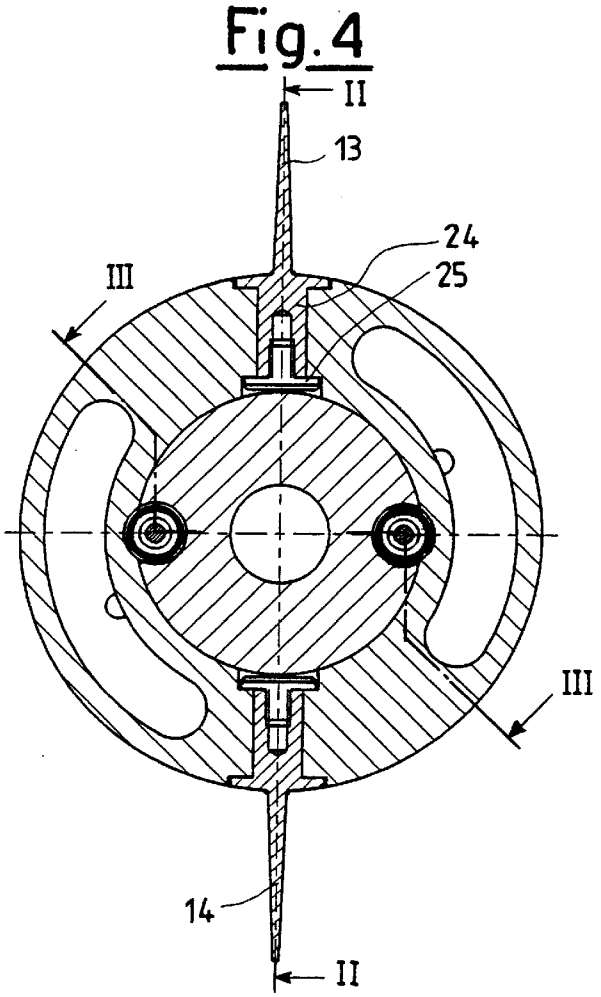

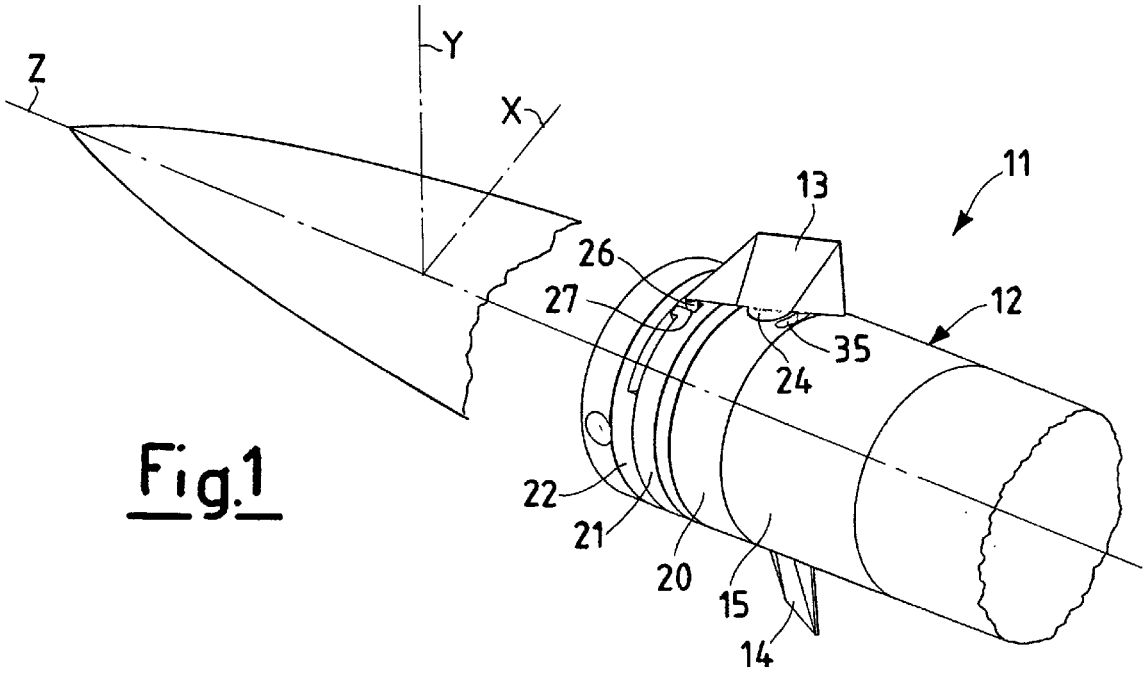
Fig.1
Fig.7
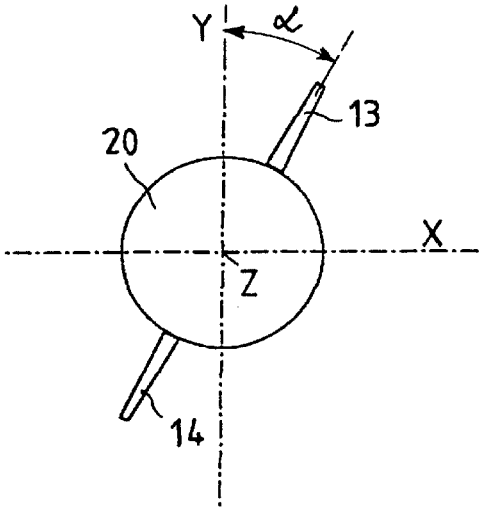
Fig.6
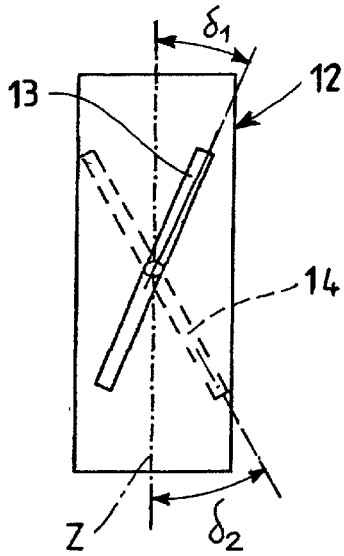

II
13
24
25
III
III
II
14

V
26
22
25
15''
33
32
28
V
27
21
13
24
IV
20
12
15
16
23
31
15'
14
IV
35
34
16

CONTROL GROUP FOR DIRECTIONAL FINS ON MISSILES AND/OR SHELLS

The present invention refers to a control group for directional fins on missiles and/or shells.

In the field of flying objects, such as shells and/or missiles, which during flight can be suitably directed, various solutions are used to be able to vary such a direction.

Currently, the solutions in use in the aforementioned field can summarily be classified hereafter, according to the type of control which is foreseen.

A first example is that consisting of a so-called Cartesian type control.

With this type of control the flying object is equipped with four fin surfaces arranged on opposite sides with respect to a diametral direction of the section of the flying object itself. By moving the first two surfaces and the second two surfaces, which are opposite to each other, in an integral manner the flying object, such as a missile, controls the yawing and pitching movements. The situation is different if the first and the second pair of fin surfaces are moved to oppose each other since in such a way the rolling movement can also be controlled.

In such an arrangement with two pairs of wing surfaces, to carry out the movement of the control surfaces themselves various motors are necessary; more precisely two motors must be foreseen in the case in which the opposite pairs of fin surfaces are joined together, whereas three or four motors must be foreseen in the case in which one wishes to control the individual fin surfaces with control of the rolling axis. Consequently, there is a certain complicatedness of phased arrangement of the motors, a substantial number of which are foreseen.

A second example is that consisting of a so-called polar type control.

With this type of control only two control surfaces are available under the form of fin surfaces and these fin surfaces, according to the plane in which they are arranged, control the yawing and pitching axes of the flying object. In this second case at least two motors are necessary: the first motor which controls the inclination of the control fin surfaces and the second motor which directs the plane of the fin surfaces themselves along the rolling axis.

A third example consists of a so-called mixed type control.

In this case four fin surfaces are arranged, in sets of two of different types arranged successively along the body of the flying object. Therefore, there are two first different consecutive surfaces which move the rolling axis of the flying object, whereas the remaining two different consecutive surfaces are relative to the yawing and pitching movements.

Also in this case at least two motors are necessary to move the aforementioned pairs of control surfaces.

All of these examples for one reason or another have some drawbacks or lackings.

The first example quoted known as cartesian control requires from two to four motors to command the control fin surfaces. Moreover, having four fin surfaces, it has a high aerodynamic resistance.

As for the second example, if on the one hand it has a better aerodynamic penetration, on the down side the manoeuvre thereof takes place in two necessarily successive steps. Indeed, there is a first step in which it is necessary to direct the plane of the control fin surfaces and then a second step which is used to move them in order to direct the flying object. All of this has a negative influence on the response speed of the missile to a command which is sent to it. Moreover, the control system of the first step requires that the servomotors have a relevant torque to direct the plane of the fins along the rolling axis.

Finally, the third example also has the drawback of having two steps in sequence those being the one directing the surfaces and the one for manoeuvre. The presence of these two successive steps slow down its capacity to manoeuvre with respect to the first example. Moreover, with respect to the second example this third example has a higher aerodynamic resistance foreseeing four different fin surfaces.

A main purpose of the present invention is that of specifying a different solution to the aforementioned technical problem which takes account of that which is foreseen by the prior art outlined.

Another purpose is that of realising a control group for directional fins for missiles and/or shells which allows all of the problems previously referred to to be optimised.

Yet another purpose is that of realising a control group for directional fins on missiles and/or shells which has a structure which is extremely simple and even is also not very expensive, still being capable of carry out any one of the tasks assigned to it in an optimal manner.

The last but not least purpose of the present invention is that of realising a control group for directional fins on missiles and/or shells which has a high manoeuvrability to be able to follow targets of any all types in all conditions.

These purposes according to the present invention are achieved by realising a control group for directional fins on missiles and/or shells as outlined in the attached claim 1.

Furhter relevant and special characteristics of the present invention are object of the dependent claims.

Figure 2:
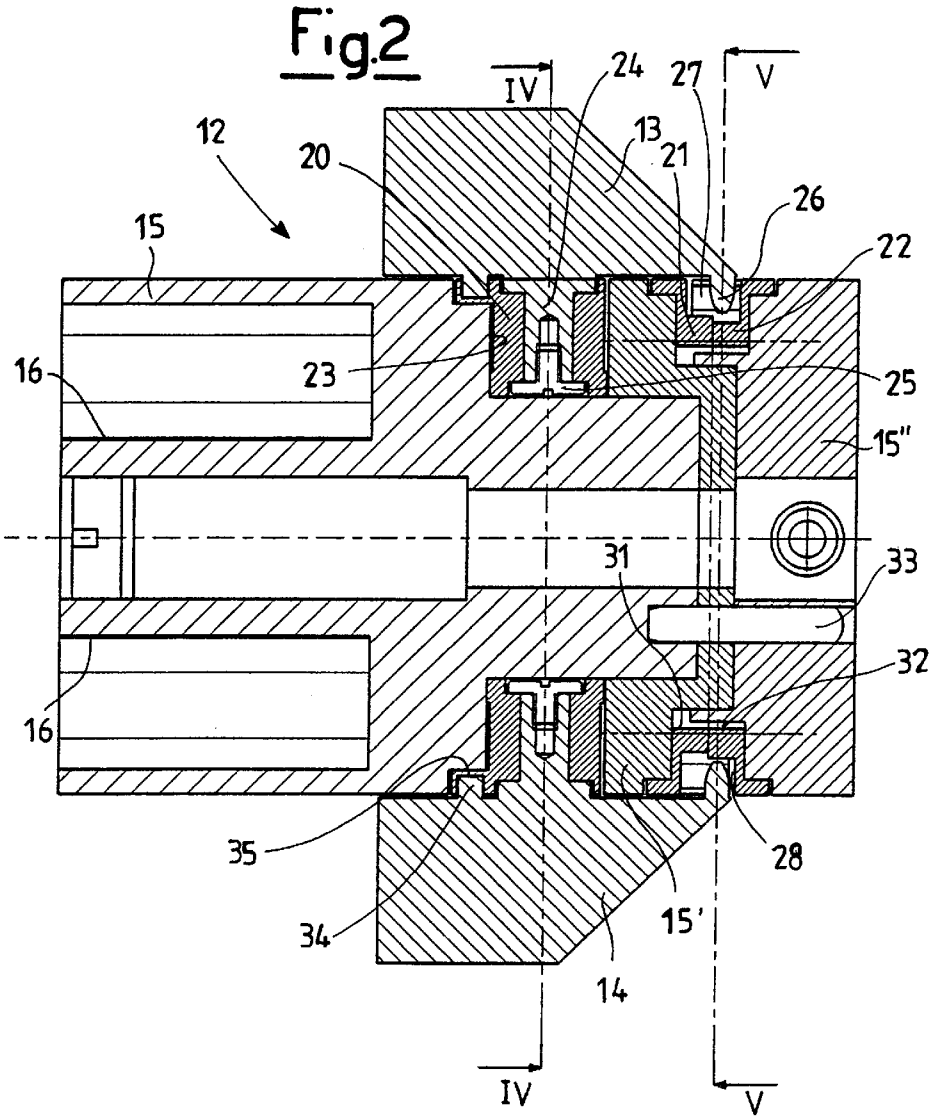
Figure 3:
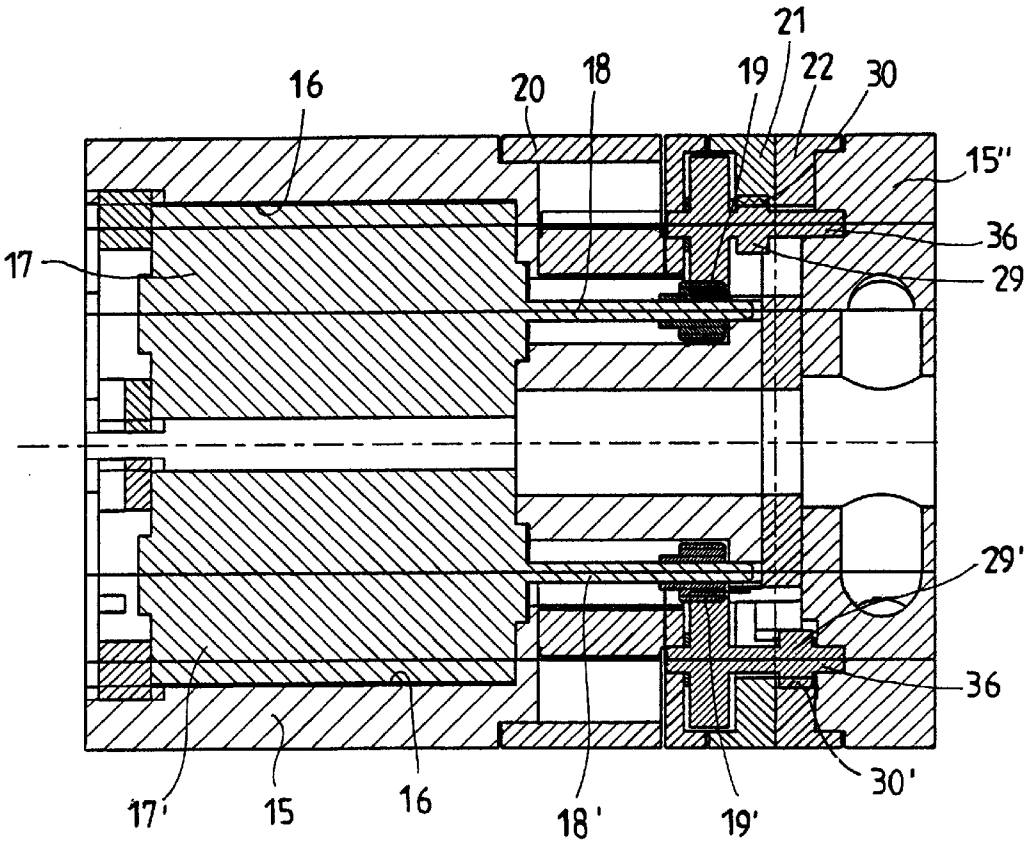
Figure 5:
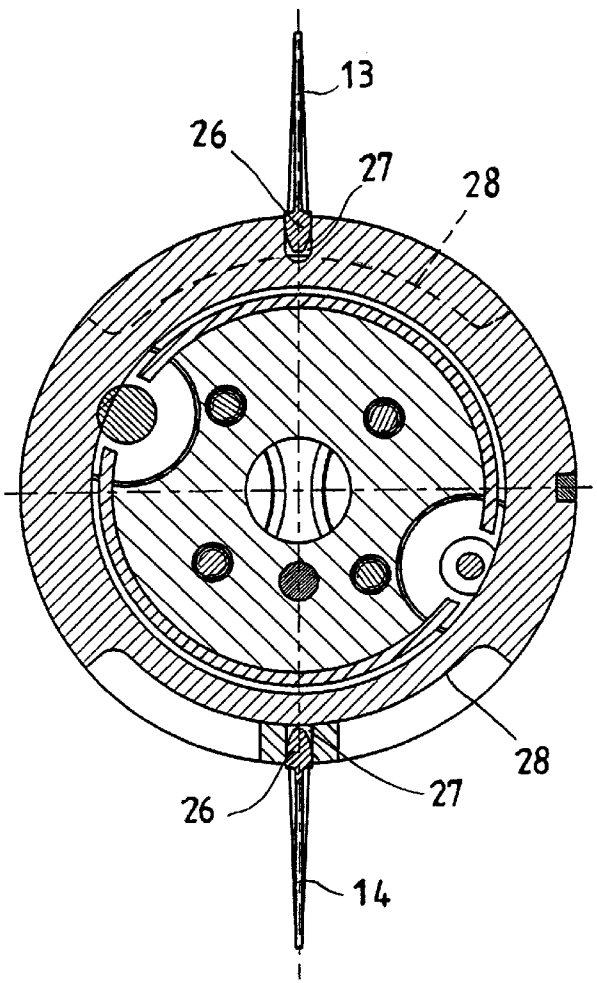

Further characteristics and advantages of a control group for directional fins on missiles and/or shells according to the present invention shall become clearer from the following description, given as an example and not for limiting purposes, of an embodiment of the group with reference to the attached figures in which:

FIG. 1 is a perspective view of a possible schematic embodiment of a control group according to the present invention for directional fins applied to a flying object, such as a missile or the like, shown only in part, FIG. 2 is a longitudinal section view of the control group of the flying object according to the line II—II of FIG. 4, FIG. 3 is a longitudinal section view of the control group of the flying object according to the line III—III of FIG. 4, FIG. 4 is a cross section of the control group of the flying object according to the line IV—IV of FIG. 2, FIG. 5 is a cross section of the control group of the flying object according to the line V—V of FIG. 2, FIGS. 6 and 7 show extremely schematically the angles of rotation of the half-fins and of the rings constituting the control group of the invention.

With reference to FIG. 1 a flying object 11 is generically indicated, such as a shell, a missile and/or the like which is equipped with a control group for directional fins according to the invention, wholly indicated with 12.

The control group 12 can be easily adapted to any type of flying object and allows such an object, moving at supersonic speeds, to be manoeuvred in order to make it strike a designated target. Indeed, this group allows a high manoeuvrability in all of its operating range in order to follow the movements of the target even when it is close to it. The solution adopted allows the system to be controlled also in the presence of a rolling movement of the flying object.

The flying object 11 requires a series of movements defined by a pitching axis X, a yawing axis Y and a rolling axis Z, respectively.

For a better understanding of the present invention a schematisation of the flying object 11 in the form of a missile and of its movements defined according to the aforementioned axes is shown in FIG. 1.

Regarding which it must be noted that a control group 12 according to the invention is a so-called polar type control, in which only two command surfaces are available in the form of two fin or half-fin surfaces 13 and 14 which can be directed according to the direction which one wishes to pursue with the flying object 11.

The command group of the invention exploits aerodynamic force to direct the plane of the control fin surfaces along the rolling axis Z, in this way by-passing the hindrance of a high pair necessary to direct such a plane directly through a motor.

In the illustrated practical embodiment it should be noted that the control group 12 comprises a containment body 15, of the cylindrical type, in which two housings 16 are formed, with their axis parallel to the axis of the containment body 15, but eccentric and diametrally opposed. Each housing 16 receives a respective electrical motor 17 and 17' which commands an end sprocket 19 and 19' through a relative shaft 18 and 18'.

It should be noted that coaxially to the axis Z of the flying object, aligned with the axis of the containment body 15, a series of three rings 20, 21 and 22 are foreseen. The first ring 20 is free to rotate about the axis Z inserted in an annular seat 23 formed in a portion with a small diameter of the the containment body 15 itself. The first ring 20 carries pivot extensions 24 of the two half-fins 13 and 14, fastened through axial locking elements 25, but free to rotate, which are thus pivoted to it and arranged at 180° from each other. In their rear part the two half-fins 13 and 14 carry a small radial extension 34 facing towards the inside of the body 15, which engages in a curved slot 35 formed in an extension 20' of the ring 20. In such a way, as can clearly be seen in FIG. 1, each half-fin 13 and 14 is guided and has a limited oscillation.

In their front part the half-fins 13 and 14 each carry an attachment 26 which can be made to oscillate with a suitable engagement with the rings 21 and 22. It should be noted how the two rings 21 and 22 are also arranged in respective grooved annular seats 31 and 32 at least partially formed in two separate portions 15' and 15" of the containment body 15 which are then fastened to said body through stable fastening elements, such as bolts schematised at 33. In such a way the containment body 15, 15' and 15", once assembled, can be considered as a single piece.

FIGS. 2–5 show a non-limiting embodiment of the control group of the present invention. It should thus be noted that, for example, the attachment 26 of the first half-fin 13 inserts into a localised groove 27 of the third ring 22 so that a rotation thereof determines its oscillation about the respective pivot 24 arranged in the first ring 20. However, this localised groove 27 protrudes forking towards the second ring 21 inserting itself into a groove 28 of the second ring, formed facing along about a quarter of the circumference of the second ring itself and being of a depth of little more than that of each attachment 26.

The third ring 22 in a position diametrically opposed to the aforementioned localised groove 27 also has a groove 28 formed along about a quarter of its circumference and being of a depth of little more than that of each attachment 26. In such a way, the attachment 26 of the second half-fin 14 inserts into a localised groove 27 of the second ring 21, which protrudes forking towards the third ring 22 inserting into its groove 28. In this way the attachment 26 of the second half-fin 14 inserts into the localised groove 27 of the second ring 21 so that a rotation thereof determines its oscillation about the respective pivot 24 also arranged in the first ring 20.

For better guiding in their possible oscillation or rotation the rings 21 and 22 have surface and perimetric extensions 21' and 22' which are housed in perimetric surface extensions of the respective annular seats 31 and 32.

It should be noted that the two rings 21 and 22 are in turn each controlled by a respective electric motor 17 and 17', which, as stated, commands, through a relative shaft 18 and 18', an end sprocket 19 and 19'. This sprocket 19 and 19' in turn engages in a gear-down 29 and 29' which finally engages in a toothing 30 and 30' formed inside each of the two rings 21 and 22. The gear-down 29 and 29' can foresee a spindle 36 carrying a pair of sprockets, of different diameters and fitted onto it, one which engages with the sprocket 19 and 19' and the other with the toothing 30 and 30' formed internally on the respective rings 21 and 22. Such a spindle 36 is brought onto the two separate portions 15' and 15" of the containment body 15 itself.

In this way each electric motor 17 and 17', through an appropriate gear-down group (consisting exclusively of cylindrical wheels 19, 29; 19', 29'), is capable of making the half-fins 13 and 14 take up angles $\delta_1$ and $\delta_2$ with respec to the axis of the shell Z.

FIGS. 2, 4 and 5 show the normal arrangement of the half-fins 13 and 14 aligned according to the axis Z of the containment body 15 of the control group 12, whereas FIG. 1 shows an oscillated operating position of a certain angle of the two half-fins 13 and 14.

FIGS. 6 and 7, which are totally schematic, help to understand what are the angles of rotation of the half-fins 13 and 14 and of the rings 20, 21 and 22 constituting the control group 12 according to the present invention.

The command with respect to the flying object 11 pitching and/or yawing is equal to $(\delta_1+\delta_2)/2$, whereas the rolling position is subject, through aerodynamic pairs, to the amount $(\delta_1-\delta_2)/2$. In other words, if the half-fins 13 and 14 move concurrently as the same piece the flying object manoeuvres to pitch and/or yaw, whereas if the half-fins do not move concurrently the system is directed about the rolling axis Z.

In an example, using as reference symbols $\alpha$, $\beta$ and $\gamma$, only the first of which is shown, the rotations about the rolling axis Z of the three rings 20, 21 and 22 and $\tau$ a generic transmission ratio, it can be seen (through kinematic considerations) that the following relationships are valid.

$$\delta_1=(\beta-\gamma)/\tau$$

$$\delta_2=(\alpha-\gamma)/\tau$$

$$(\delta_1+\delta_2)/2=(\beta-\gamma)/2/\tau \text{ pitching/yawing command}$$

$$(\delta_1-\delta_2)/2=(\beta+\gamma-2\alpha)/\tau \text{ rolling position command}$$

The advantage with respect to other systems or control groups is that to move about the rolling axis Z it exploits the aerodynamic pair which develops when the angles of incidence of the fins $\delta_1$ and $\delta_2$ are different thus avoiding the need for the servomotors 17, 17' to supply a high torque.

This proposed solution is obviously particularly useful for commanding missiles, shells and/or the like through the movement of suitable control fin surfaces (13, 14). Thus, the main purpose of the present invention is achieved which proposed to manoeuvre an object, such as a missile and/or shell, which moves at supersonic speed, so as to make it strike a designated target.

The whole thing, obviously, with a high and easy manoeuvrability so as to be able to pursue the movements of the target even when close to the target itself.

With the solution of the present invention previously outlined it is made possible to control the flying object also in the presence of a rolling movement of the flying object itself.

The control group of the present invention, thus conceived, is obviously susceptible to numerous modifications and variants, all covered by the invention itself.

Moreover, in practice the parts and the materials used, as well as their sizes and components, can be whatever according to the specific technical requirements.

The scope of protection of the present invention is therefore defined by the attached claims.

What is claimed is:

1. Control group for directional fins on missiles or shells comprising a containment body (15, 15', 15") carrying on the outside two command surfaces in the form of half-fin surfaces (13, 14) which are hinged (at 24, 25), directable and motorized, characterized in that said containment body (15, 15', 15") has two housings (16) each of which received an electric motor (17, 17') which commands, oscillation about an axis (Z) of said reduction gear group, of through a reduction gear group (19, 29; 19', 29'), a pair of rings (21, 22), arranged in first annular seats (31, 32) and in which end attachments (26) of said half-fins (13, 14) engage, said half-fins (13, 14) being hinged diametrically opposed in a further ring (20) arranged in second annular seat (23) of said containment body (15, 15', 15") said half-fins being free to rotate about said axis (Z).

2. Control group according to claim 1, characterised in that each of said rings (21, 22) has a localised groove (27) to receive an end attachment (26) of one (13 or 14) of said half-fins (13, 14) and a groove (28) formed along at least a quarter of the circumference of said ring which is of a depth little greater than that of an attachment (26) which receives an attachment of the other (14, 13) of said half-fins (13, 14), said groove (28) of a ring (21 or 22) facing the localised groove (27) of the other ring (22 or 21).

3. Control group according to claim 2,characterised in that said localised groove (27) of one ring (21 or 22) faces towards the other ring (22 or 21) inserted into said groove (28).

4. Control group according to claim 1, characterised in that said reduction gear group associated with said electric motor (17, 17') comprises sprockets (19, 29; 19', 29') which engage by means of a reduction gear in a toothing (30, 30') formed internally on each of said two rings (21, 22).

5. Control group according to claim 4, characterized in that said reduction gear is a toothed reduction gear which comprises a spindle (36) carrying a pair of sprockets, with different diameters and fitted onto said spindle, a first sprocket which engages with a sprocket (19, 19') that is integral with said motor (17, 17') and the second sprocket engaging with said toothing (30, 30') that is formed internally on respective rings (21, 22), said spindle (36) being supported on two separate portions (15',15") of said containment body (15).

6. Control group according to claim 1, characterised in that each of said half-fins (13, 14) foresees a pivoted extension (24), fastened through axial locking elements (25), but free to rotate, in said further ring (20), said two half-fins (13, 14) being arranged at 180° from each other.

7. Control group according to claim 1, characterised in that said containment body comprises three separate portions (15, 15', 15"), fastened together through stable fastening means (33), said grooved annular seats (31, 32, 23) are located within said three separate portions.

8. Control group according to claim 1, characterised in that each of said half-fins (13, 14) foresees, in a rear part thereof, a small radial extension (34), facing towards the inside of said containment body (15, 15', 15"), which engages in a curved slot (35) formed in an extension (20') of the further ring (20).

9. Control group according to claim 1, characterised in that each of said pairs of rings (21, 22), arranged in the annular seats (31, 32), have a surface and perimetric extension (21', 22') which is housed in a perimetric surface extension of said annular seats (31, 32).

* * * * *